United States Patent [19]

Takada

[11] Patent Number: 5,065,491

[45] Date of Patent: Nov. 19, 1991

[54] METHOD FOR PRODUCING CURVED SLIDE FASTENER CHAINS AND METHOD FOR PRODUCING CURVED SLIDE FASTENERS

[75] Inventor: Shigeki Takada, Kurobe, Japan

[73] Assignee: Yoshida Kogyo K. K., Tokyo, Japan

[21] Appl. No.: 420,359

[22] Filed: Oct. 12, 1989

[30] Foreign Application Priority Data

Oct. 14, 1988 [JP] Japan ..... 63-257300

[51] Int. Cl.[5] ..... B21D 53/50

[52] U.S. Cl. ..... 29/408; 427/307; 8/130.1

[58] Field of Search ..... 29/408, 410; 24/397, 24/398; 428/423.1, 814; 427/307, 275; 8/130.1, 132; 246/323, 343

[56] References Cited

U.S. PATENT DOCUMENTS 3,973,905 8/1976 Wilson ..... 8/130.1
4,607,425 8/1986 Terasawa ..... 29/408

FOREIGN PATENT DOCUMENTS 796015 10/1968 Canada ..... 24/398

*Primary Examiner*—Joseph M. Gorskl
*Assistant Examiner*—S. Thomas Hughes
*Attorney, Agent, or Firm*—Hill, Van Santen, Steadman & Simpson

[57] ABSTRACT

A method of producing curved slide fastener chains or a curved slide fasteners is disclosed. Fastener elements are planted along respective one side edges of a pair of fastener tapes, at least one of which tapes is made of solvent-swelling fibers. The fastener elements planted on the respective tapes are inter-engaged with each other to form a fastener chain. A solvent or its aqueous solution, or a solution containing a solvent and dissolving a soluble adhesive, is applied onto either one of the fastener tapes made of solvent-swelling fibers. Subsequently, the fastener chain is shaped into a desired curved configuration. The shaped fastener chain has its curved configuration fixed by being served on a texture, by solidification of the adhesive dissolved in the solvent after evaporation of the solvent or by applying an adhesive onto the shaped fastener chain and solidifying the adhesive. By mounting a slider, upper stops and lower stops to the fastener chain before or after the above-described shaping, curved slide fasteners can be similarly produced.

9 Claims, 1 Drawing Sheet

METHOD FOR PRODUCING CURVED SLIDE FASTENER CHAINS AND METHOD FOR PRODUCING CURVED SLIDE FASTENERS

BACKGROUND OF THE INVENTION

1. Field of the Invention

The present invention relates to a method for producing curved slide fasteners which are used as sewed on bags, children bags, pocket portions of cloths, etc. and also to a method for producing curved slide fastener chains used as preparatory products for the former.

2. Description of the Prior Art

Heretofore, in the production of curved slide fasteners, in the case of metallic fasteners it has been practiced that a pitch (interval) between the respective fastener elements planted on one side edge of one fastener tape is chosen large, while a pitch of the respective fastener elements planted on one side edge of the other fastener tape is chosen small, and thereby a curved inter-engaged portion is formed by the difference of pitches (for instance, see Laid-Open Japanese Patent Specification No. 59-103607 (1984)). Also, in the case of coil fasteners it has been practiced to form a curved configuration by heating with a heater. Furthermore, as methods other than the above-described method, a method of cutting slits in a fastener tape portion and then sewing it on cloths or a method of using left and right fastener tapes having different widths has been practiced.

However, in the case of the above-described .method of forming a curved inter-engaged portion by the difference of pitches, the production was complicated and expensive in cost, and the methods of making use of a heater, cutting slits in the fastener tape portion, and using left and right fastener tapes having different widths, involved probelms such that generally it was difficult to shape into a desired curved configuration and sewing thereof was troublesome.

SUMMARY OF THE INVENTION

It is, accordingly, one aim of the present invention to provide a method of producing curved slide fastener chains and curved slide fasteners which can be simply shaped into a desired curved configuration (into a curved portion having a desired curvature) and can be easily sewed.

Another aim of the present invention is to provide a method of producing curved slide fastener chains and curved slide fasteners which can be simply shaped into a desired curved configuration arbitrarily at the place of sewing upon sewing work.

In order to achieve the foregoing aims, according to one feature of the present invention, there is provided a method of producing curved slide fastener chains, consisting of the steps of planting a plurality of fastener elements along respective one side edges of a pair of fastener tapes, at least one of which tapes is made of solvent-swelling fibers, inter-engaging the plurality of fastener elements on the respective tapes with each other to form a fastener chain, applying a solvent or its aqueous solution onto either one of the above-mentioned pair of fastener tapes made of solvent-swelling fibers, subsequently shaping this fastener chain into a desired curved configuration, and thereafter sewing the curved fastener chain onto a texture.

According to another feature of the present invention, there is provided a method of producing curved slide fastener chains, consisting of the steps of planting a plurality of fastener elements along respective one side edges of a pair of fastener tapes, at least one of which tapes is made of solvent-swelling fibers, inter-engaging the plurality of fastener elements on the respective tapes with each other to form a fastener chain, applying a solution containing a solvent and dissolving a soluble adhesive onto either one of the above-mentioned pair of fastener tapes made of solvent-swelling fibers, and shaping this fastener chain into a desired curved configuration.

According to still another feature of the present invention, there is provided a method of producing curved slide fastener chains, consisting of the steps of planting a plurality of fastener elements along respective one side edges of a pair of fastener tapes, at least one of which tapes is made of solvent-swelling fibers, inter-engaging the plurality of fastener elements on the respective tapes with each other to form a fastener chain, applying a solvent or its aqueous solution onto either one of the above-mentioned pair of fastener tapes made of solvent-swelling fibers, subsequently shaping this fastener chain into a desired curved configuration, and thereafter applying an adhesive onto the above-mentioned fastener tapes.

According to yet another feature of the present invention, there is provided a method of producing curved slide fasteners, including the steps of mounting the respective parts such as a slider, upper stops and lower stops to the curved slide fastener chain produced through any one of the above-featured methods, and finishing into a slide fastener having a predetermined length.

According to a further feature of the present invention, there is provided a method of producing curved slide fasteners, in which a slide fastener of a predetermined length having the respective parts such as a slider, upper stops and lower stops mounted a fastener chain is used in place of the slide fastener chain in the above-featured respective methods.

In the method according to the present invention, a slide fastener or a slider fastener chain is formed into a curved configuration by making use of the property that solvent-swelling synthetic fibers (for instance, polyurethane fibers), would swell (expand) by treating it with a solvent. In more particular, by applying a solvent onto a tape portion of a fastener stringer on one side of a slider fastener chain making use of a fastener tape in which polyurethane fibers are woven in the direction of warps, only the fastener tape on that one side would elongate in the warp direction as the polyurethane fibers expands, and as a result, the slide fastener chain can be shaped into a curved configuration in an extremely simple manner.

The above-mentioned and other aims, features and advantages of the present invention will become more apparent by reference to the following detailed description of the invention taken in conjunction with the accompanying drawings.

BRIEF DESCRIPTION OF THE DRAWINGS

In the accompanying drawing consisting of only one sheet.

DETAILED DESCRIPTION OF THE INVENTION

Figure 1A:
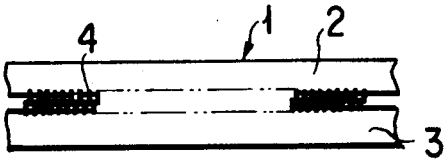
FIGS. 1A to 1E are schematic views showing successive steps of one method according to the present invention.
Figure 1B:
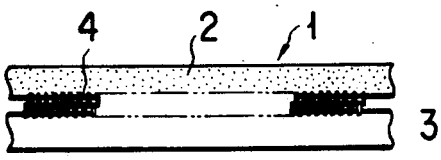
Figure 1C:
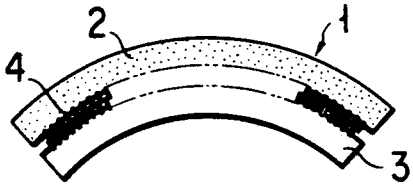

In the following, the method according to the present invention will be described in greater detail with reference to FIGS. 1A to 1E, which illustrate the successive steps in the method of producing a curved slide fastener chain. In these figures, reference numerals 2 and 3 designate fastener tapes in which polyurethane fibers, which are solvent-swelling fibers, are woven in the direction of warps, a plurality of fastener elements 4 are planted along one side edges of the pair of fastener tapes 2 and 3, and these plurality of fastener elements are inter-engaged to form a fastener chain 1 (See FIG. 1A). It is to be noted that in the drawing a fastener chain of unit length is illustrated. Subsequently, among the above-mentioned pair of fastener tapes 2 and 3, onto one fastener tape 2 or onto the both fastener tapes 2 and 3 is applied a solvent or its aqueous solution through any appropriate method such as spraying, brush-painting or the like. For convenience of explanation, in FIG. 1B illustration is made for the case where a solvent has been applied onto one of fastener tapes, for instance, onto the fastener tape 2, and the applied portion is indicated by shades. After a while (normally about several seconds), the polyurethane fiber yarns would expand (swell), and so, the fastener chain 1 can be easily shaped into a predetermined curved configurations (See FIG. 1C). Subsequently, in order to fix this curved configuration, this fastener chain 1 shaped into a predetermined curved configuration is sewed onto a texture 5 (See FIG. 1D). If the fastener chain is held under this condition for a while, the solvent impregnated in the fastener tape 2 would evaporate, and thus a curved slide fastener chain having a predetermined curved configuration can be obtained (See FIG. 1E). The curvature of the curve of the curved slide fastener chain can be arbitrarily adjusted by appropriately selecting the amount of application of the solvent and the kinds of the solvent. Furthermore, as will be apparent from the above description, the method according to the present invention is applicable so long as among a pair of fastener tapes at least one tape is made of solvent-swelling fibers.

While fixation by sewing was illustrated in FIGS. 1A to 1E, a method of employing a resin adhesive and fixing by curing of resin is also possible. More particularly, in a second method according to the present invention, among a pair of fastener tapes, onto either one fastener tape made of solvent-swelling fibers is applied a solution containing a solvent and dissolving a soluble adhesive, thus the fastener chain is shaped into a predetermined curved configuration by making use of expansion (swelling) of the fastener tape caused by the solvent, and thereafter as a result of solidification of the adhesive after evaporation of the solvent, a curved slide fastener chain solidified in the aforementioned predetermined curved configuration can be obtained. In addition, in a third method according to the present invention, after a fastener chain has been shaped into a predetermined curved configuration through the steps illustrated in FIGS. 1A to 1C, by applying an adhesive onto the fastener tape 2 to fix it, a curved slide fastener chain can be obtained. While urethane group adhesives can be used as the adhesive, especially if a hot-melt type adhesive is employed, there is a merit that the degree of curving can be rectified later by heating.

According to the present invention, a curved slide fastener can be simply produced by mounting the respective parts such as a slider, upper stops and lower stops to the curved slide fastener chain produced through the above-described respective methods, or by applying the above-described respective methods to the existing slide fastener.

With regard to the solvent applied onto the fastener tape, while any solvent can be used so long as it can swell the fiber yarns in the fastener tape, a solvent which does not result in deterioration, degradation of mechanical strength nor the like of the fibers is favorable. Practically, alcohols such as methyl alcohol, ethyl alcohol, isopropyl alcohol, etc., ketones such as acetone, methylethyl ketone, etc., ethers such as diethyl ether or the like, a hydrocarbon group solvent such as n-hexane, petroleum ether or the like, cyclic compounds such as toluene, xylene, aniline, tetrahydrofuran, etc., halogen compounds such as trichloroethane, chloroform, carbon tetrachloride, etc., fatty acids and their esters such as n-butylacetate, acetic acid, etc., and inorganic acids.

Preferred Embodiments

In the following, the present invention will be described in more detail by presenting a number of preferred embodiment thereof as well as test examples.

Preferred embodiments 1 to 9

Fastener elements were planted along one side edges of expansible tapes (presenting elongation of 10% under loading of 410 g) of 20 mm in width and of 10 mm in width, respectively, woven of polyurethane fibers, the fastener elements on these paired expansible tapes were inter-engaged with each other, and thereby a fastener chain was produced. The total width of the produced fastener chain was 33 mm.

Figure 2:
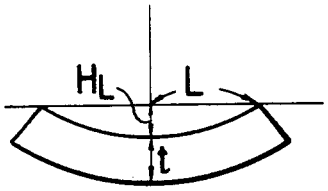
FIG. 2 is a schematic view showing the mode of chain bias measurement.
Figure 1D:
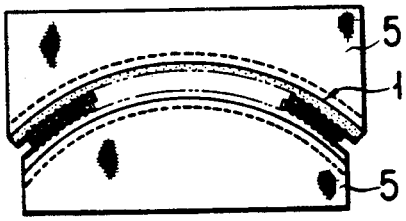
Figure 1E:
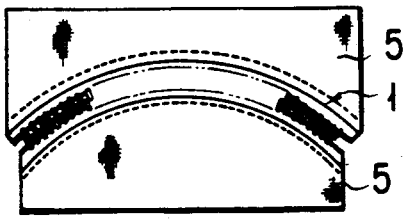

Subsequently, onto the tape portion of one tape of 20 mm in width of the above-described fastener chain were applied the respective kinds of solvents indicated in Table-1 by an appropriate amount (applied by a bush three times), and immediately thereafter, a chain bias was measured. The mode of measurement of the chain bias $H_L$ is as shown in FIG. 2, in which $L=150$ mm and $t=33$ mm were measured. The test results are also indicated in TABLE 1.

TABLE 1

| Embodiment Nos. | Solvent Name | Solvent Boiling Point (°C.) | Bias (mm) Before Test | Bias (mm) After Test | Proportion of Elongation of Tape Applied with Solvent (%) |
|---|---|---|---|---|---|
| 1 | Trichloroethane | 74.1 | 6 | 47 | 10.60 |
| 2 | Acetone | 56.3 | 6 | 35 | 7.84 |
| 3 | Methanol | 64.7 | 8 | 26 | 4.94 |
| 4 | Xylene | 144.0 | 7 | 82 | 16.14 |
| 5 | Benzyl Alcohol | 206 | 7 | 62 | 13.21 |
| 6 | Petroleum Ether | 30~70 | 8 | 27 | 5.21 |
| 7 | Ethanol | 78.3 | 7 | 26 | 5.24 |
| 8 | Methyl-Ethyl Ketone | 79.6 | −6 | 46 | 14.34 |
| 9 | Toluene | 110.6 | −6 | 62 | 17.60 |

The obtained fastener chain was shaped by hands into a curved configuration, the configuration was fixed by sewing it onto a texture, or fixed by applying a polyurethane group adhesive, and thereby a curved slide fastener chain was produced.

As will be apparent from the results shown in TABLE-1 above, a proportion of elongation (a degree of expansion) of a tape is different depending upon the kind of the used solvent. Accordingly, by appropriately selecting a solvent to be used, the configuration can be adjusted to a desired degree of curve.

Test Example 1

With respect to a sole tape itself, influence by immersing it in a solvent was investigated. At first, a weight of initial loading of 15 g is put to the elastic tape preliminarily used in the above-described embodiments, and an interval of 20 cm at that movement is measured.

Next, it is immersed for 30 seconds in the respective kinds of solvent shown in TABLE-1, and after it has been dried by airflow for 90 seconds, starting from 2 minutes after the drying, proportions of elongation up to 12 minutes after at an interval of 2 minutes and at 20 minutes after are measured. The results are shown in TABLE-2.

TABLE 2

| Names of Solvent | Practically Measured Elongation of Tape After Lapse of Respective Periods (mm) | | | | | | |
|---|---|---|---|---|---|---|---|
| | 2 Min. After | 4 Min. After | 6 Min. After | 8 Min. After | 10 Min. After | 12 Min. After | 20 Min. After |
| Trichloro Ethane | 22 | 22 | 22 | 18 | 8 | 5 | — |
| Acetone | 11 | 11 | 7 | 4 | 0 | — | — |
| Methanol | 7 | 6 | 5 | 4 | 4 | 4 | — |
| Xylene | 22 | 22 | 22 | 22 | 22 | 22 | 22 |
| Benzyl Alcohol | 19 | 20 | 22 | 23 | 23 | 24 | 24 |
| Petroleum Ether | 4 | 0 | — | — | — | — | — |
| Ethanol | 13 | 13 | 13 | 13 | 13 | 13 | 12 |
| Methyl-Ethyl Ketone | 17 | 16 | 16 | 8 | 0 | — | — |
| Toluene | 23 | 23 | 23 | 23 | 23 | 23 | 22 |

*Upon measurement, the temperature of the atmosphere was 24~25° C.

From the above results, it is seen that depending upon the kind of solvent, there are differences in the influent upon strength of a tape, and in the evaporation speed of the solvent. It is to be noted that in any case, discoloration of a tape caused by immersion in a solvent was not observed.

Preferred Embodiment 10

As materials of the used tapes, those shown in TABLE-3 were employed, and except for the use of the respective solvents shown in TABLE-4, fastener chains were produced in a similar manner to the above-described embodiments and a chain bias was measured in a similar manner. The results are also shown in TABLE-4. With regard to the influence of immersion in a solvent upon a sole tape itself, also investigation was made exactly in the same manner as the above-described Test Example 1. The results are shown in TABLE-5.

TABLE 3

| Sample Nos. | Test Chain Tape Materials | Tape Formation |
|---|---|---|
| A | Polyester | woven |
| B | Cotton | woven |
| C | Tetron/Rayon Mixed Spun | woven |
| D | Polyester | knit |
| E | Polyurethane (90%) Polyester (10%) | knit |

TABLE 4

| Name of Solvent | Chain Sample Nos. | Bias (m/m) Before Test | Bias (m/m) After Test | Proportion of Elongation of Tape Applied with Solvent (%) | Boiling Point of Solvent (°C.) |
|---|---|---|---|---|---|
| Trichloro Ethane | A | 0 | 0 | 0 | 74.1 |
| | B | 0 | 0 | 0 | |
| | C | 0 | 0 | 0 | |
| | D | 0 | 0 | 0 | |
| | E | 0 | 26 | 7.4 | |
| Toluene | A | 0 | 0 | 0 | 110.6 |
| | B | 0 | 0 | 0 | |
| | C | 0 | 0 | 0 | |
| | D | 0 | 0 | 0 | |
| | E | 0 | 52 | 13.6 | |
| Acetic Acid | A | 0 | 0 | 0 | 118.0 |
| | B | 0 | 0 | 0 | |
| | C | 0 | 0 | 0 | |
| | D | 0 | 0 | 0 | |
| | E | 0 | 26 | 7.4 | |

TABLE 5

| Names of Solvent | Chain Sample Nos. | Change of Tape after Lapse of Respective Periods (mm) | | | | | | |
|---|---|---|---|---|---|---|---|---|
| | | 2 | 4 | 6 | 8 | 10 | 12 | 20 |
| Trichloro Ethane | A, C, D | 0 | 0 | — | — | — | — | — |
| | B | −2 | −2 | — | — | — | — | — |
| | E | 26 | 26 | 26 | 12 | 4 | — | — |
| Toluene | A, C, D | 0 | 0 | — | — | — | — | — |
| | B | 0 | 0 | — | — | — | — | — |
| | E | 25 | 25 | 25 | 25 | 25 | 24 | 18 |
| Ethanol | A, C, D | 0 | 0 | — | — | — | — | — |
| | B | −1 | −1 | — | — | — | — | — |
| | E | 12 | 12 | 12 | 12 | 11 | 11 | 5 |
| Acetic Acid | A, C, D | 0 | 0 | — | — | — | — | — |
| | B | −1 | −1 | — | — | — | — | — |
| | E | 24 | 24 | 24 | 24 | 24 | 24 | 18 |

As will be apparent from the results shown in TABLE-4 and TABLE-5 above, the present invention is applicable in the case of tapes made of solvent-swelling fibers such as polyurethane fibers.

As described above, in the method of producing curved slide fastener chains according to the present invention, since solvent is applied onto at least one of a pair of fastener tapes made of solvent-swelling fibers and by making use of the property that the one fastener tape applied with the solvent is swelled by the solvent and expands the fastener chain is shaped into a curved configuration and fixed in that configuration, curved slide fastener chains as well as curved slide fasteners can be produced in an extremely simple manner, sewing of the curved portion is easy, hence their finishment is also improved, and the size of the curve can be arbitrarily adjusted by appropriately changing the kind and the applied amount of the solvent.

In addition, the present invention is in itself applicable to a warp-stretching slide fastener that is already existing as a known item at present, and by spraying or otherwise applying a solvent thereto upon sewing, a curved slide fastener can be sewed with a freely adjustable degree of curve on the spot.

Furthermore, by making use of an ahesive for the purpose of fixing of the configuration as claimed in appended Claims 2 and 3, a merit that a slide fastener chain or a slide fastener shaped into a desired curved configuration can be simply fixed at the curved state, can be obtained.

While a principle of the present invention has been described above in connection to a number of preferred embodiment, it is intended that all matter contained in the above specification and shown in the accompanying drawings shall be interpreted to be illustrative and not in a limiting sense.

What is claimed is:

1. A method of producing curved slide fastener chains, consisting of the steps of: planting a plurality of fastener elements along respective edges opposite to each other of a pair of fastener tapes, at least one of which tapes is made of solvent-swelling fibers; inter-engaging the plurality of fastener elements on the respective tapes with each other thereby forming a fastener chain; applying a solvent onto said at least one of said pair of fastener tapes made of solvent-swelling fibers, thereby causing said at least one of said pair of fastener tapes to swell and form at least one solvent-swelled tape; subsequently shaping this fastener chain into a desired curved configuration by selectively lengthening at least a portion of said at least one solvent-swelled tape with respect to an opposite portion of the respective opposite tape thereby forming a curved fastener chain; and thereafter sewing the curved fastener chain onto a texture.

2. A method of producing curved slide fastener chains, consisting of the steps of: planting a plurality of fastener elements along respective edges opposite to each other of a pair of fastener tapes, at least one of which tapes is made of solvent-swelling fibers; inter-engaging the plurality of fastener elements on the respective tapes with each other thereby forming a fastener chain; applying a solution containing a solvent and dissolving a soluble adhesive onto said at least one of said pair of fastener tapes made of solvent-swelling fibers, thereby causing said at least one of said pair of fastener tapes to swell and form at least one solvent-swelled tape and shaping this fastener chain into a desired curved configuration by selectively lengthening at least a portion of said at least one solvent-swelled tape with respect to a an opposite portion of the respective opposite tape.

3. A method of producing curved slide fastener chains, consisting of the step of: planting a plurality of fastener elements along respective edges opposite to each other of a pair of fastener tapes, at least one of which tapes is made of solvent-swelling fibers; inter-engaging the plurality of fastener elements on the respective tapes with each other thereby forming a fastener chain; applying a solvent onto said at least one of said pair of fastener tapes made of solvent-swelling fibers, thereby causing said at least one of said pair of fastener tapes to swell and form at least one solvent-swelled tape; subsequently shaping this fastener chain into a desired curved configuration by selectively lengthening at least a portion of said at least one solvent-swelled tape with respect to an opposite portion of the respective opposite tape; and thereafter applying an adhesive onto said fastener tapes.

4. The method of producing curved slide fasteners according to claims 1, 2 or 3, further comprising the subsequent steps of: mounting a slider, upper stops and lower stops to the fastener chain, thereby forming a slide fastener having a predetermined length.

5. The method of producing curved slide fasteners according to any one of claims 1, 2 or 3 in which said solvent is selected from the group consisting of methyl alcohol, ethyl alcohol, isopropyl alcohol, benzyl alcohol, acetone, methylethyl ketone, diethyl ether, n-hexane, petroleum ether, toluene, xylene, aniline, tetrahydrofuran, trichlorethane, chloroform, carbon tetrachloride, n-butylacetate and acetic acid.

6. A method of producing curved slide fasteners, consisting of the steps of: planting a plurality of fastener elements along respective edges opposite to each other of a pair of fastener tapes, at least one of which tapes is made of solvent-swelling fibers; inter-engaging the plurality of fastener elements on the respective tapes with each other thereby forming a fastener chain; mounting a slider, upper stops and lower stops to the fastener chain thereby forming a slide fastener having a predetermined length; applying a solvent onto said at least one of said pair of fastener tapes made of solvent-swelling fibers, thereby causing said at least one of said pair of fastener tapes to swell and form at least one solvent-swelled tape, subsequently shaping the slide fastener into a desired curved configuration by selectively lengthening at least a portion of said at least one solvent-swelled tape with respect to an opposite portion of the respective opposite tape thereby forming a curved slide fastener; and thereafter sewing the curved fastener onto a texture.

7. A method of producing curved slide fasteners, consisting of the steps of: planting a plurality of fastener elements along respective edges opposite to each other of a pair of fastener tapes, at least one of which tapes is made of solvent-swelling fibers; inter-engaging the plurality of fastener elements on the respective tapes with each other thereby forming a fastener chain; mounting a slider, upper stops and lower stops to the fastener chain thereby forming a slider fastener having a predetermined length; applying a solution containing a solvent and dissolving a soluble adhesive onto said at least one said pair of fastener tapes made of solvent-swelling fibers, thereby causing said at least one of said pair of fastener tapes to swell and form at least one solvent-swelled tape, and shaping the slide fastener into a desired curved configuration by selectively lengthening at least a portion of said at least one solvent-swelled tape with respect to an opposite portion of the respective opposite tape.

8. A method of producing curved slide fasteners, consisting of the steps of: planting a plurality of fastener elements along respective edges opposite to each other of a pair of fastener tapes, at least one of which tapes is made of solvent-swelling fibers; inter-engaging the plurality of fastener elements on the respective tapes with each other thereby forming a fastener chain; mounting a slider, upper stops and lower stops to the fastener chain thereby forming a slide fastener having a predetermined length; applying a solvent onto said at least one of said pair of fastener tapes made of solvent-swelling fibers, thereby causing said at least one of said pair of fastener tapes to swell and form at least one solvent-swelled tape; subsequently shaping the slide fastener into a desired curved configuration by selectively lengthening at least a portion of said at least one solvent-swelled tape with respect to an opposite portion of the respective opposite tape; and applying an adhesive onto said fastener tapes.

9. The method of producing curved slide fasteners according to any one of claims 6, 7 or 8 in which said solvent is selected from the group consisting of methyl alcohol, ethyl alcohol, isopropyl alcohol, benzyl alcohol, acetone, methylethyl ketone, diethyl ether, n-hexane, petroleum ether, toluene, xylene, aniline, tetrahydrofuran, trichloroethane, chloroform, carbon tetrachloride, n-butylacetate and acetic acid.

* * * * *